US010498090B2

(12) United States Patent
Wu et al.

(10) Patent No.: US 10,498,090 B2
(45) Date of Patent: Dec. 3, 2019

(54) CABLE CONNECTOR ASSEMBLY

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignees: FOXCONN (KUNSHAN) COMPUTER CONNECTOR Co., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/255,860

(22) Filed: Jan. 24, 2019

(65) Prior Publication Data

US 2019/0252834 A1 Aug. 15, 2019

(30) Foreign Application Priority Data

Feb. 9, 2018 (CN) ..... 2018 1 0133209

(51) Int. Cl.

| | |
|---|---|
| ***H01R 4/66*** | (2006.01) |
| ***H01R 13/6594*** | (2011.01) |
| ***H01R 13/66*** | (2006.01) |
| ***H01R 13/6593*** | (2011.01) |
| *H01R 107/00* | (2006.01) |
| *H01R 12/57* | (2011.01) |
| *H01R 24/60* | (2011.01) |

(52) U.S. Cl.

CPC ..... *H01R 13/6594* (2013.01); *H01R 13/6593* (2013.01); *H01R 13/665* (2013.01); *H01R 12/57* (2013.01); *H01R 24/60* (2013.01); *H01R 2107/00* (2013.01)

(58) Field of Classification Search

CPC ..... H01R 13/4532; H01R 23/662
USPC ..... 439/95, 607.01, 497, 610, 143
See application file for complete search history.

(56) References Cited

U.S. PATENT DOCUMENTS

| | | | | |
|---|---|---|---|---|
| 6,764,342 | B2 * | 7/2004 | Murayama | H01R 4/023 439/607.1 |
| 6,893,295 | B1 * | 5/2005 | Lloyd | H01R 12/772 439/607.05 |
| 10,158,190 | B1 | 12/2018 | Sun et al. | |
| 2012/0090872 | A1 * | 4/2012 | Gundel | H01B 7/0861 174/102 R |

* cited by examiner

*Primary Examiner* — Phuong Chi Thi Nguyen
(74) *Attorney, Agent, or Firm* — Wei Te Chung; Ming Chieh Chang

(57) ABSTRACT

A cable connector assembly includes an electrical connector and a cable connected with the electrical connector, the electrical connector including a mating plug for mating with a mating connector, a circuit board mated with the mating plug and the cable, and a metal housing disposed outside the circuit board, the cable including a plurality of core wires and a shield layer disposed outside thereof, the metal housing electrically connected with the shield layer. The circuit board has a lug disposed thereon that has a grounding portion, the metal housing electrically connected with the grounding portion of the lug for grounding.

12 Claims, 18 Drawing Sheets

CABLE CONNECTOR ASSEMBLY

BACKGROUND OF THE INVENTION

1. Field of the Invention

The present invention relates, generally, to a cable connector assembly, and more particularly, to a cable connector assembly that can transmit a high current.

2. Description of Related Arts

With wide application of the USB C interface, the DisplayPort alternate mode USB C and the HDMI alternate mode USB C have gradually matured, and the length of the AV cable assembly is concentrated on 1.8 m, 2.0 m. The advantages of the USB C in addition to providing high-quality and high-frequency data transmission, the high current 3 A and even 5 A specified by the USB PD (Power Delivery) protocol are highly sought after by various system manufacturers. The high current transmission means more power loss. It is often used to increase the diameter of the cable to overcome the problem. However, with the need of slim and flexible cable, it obviously can't get the preference of the customers.

U.S. Pat. No. 10,158,190 discloses a Type-c connector including an electrical connector, a circuit board and a shield casing, the electrical connector including a hook member welded onto the circuit board for grounding, so that the shield casing can provide its shield effect. However it is complex that it needs an extra member for grounding, and it is difficult to assembly.

Therefore, there is a need to improve the cable connector assembly.

SUMMARY OF THE INVENTION

An object of the present invention is to provide a cable connector assembly which can transmit a large current.

To achieve the above-mentioned object, a cable connector assembly includes an electrical connector and a cable connected with the electrical connector, the electrical connector including a mating plug for mating with a mating connector, a circuit board mated with the mating plug and the cable, and a metal housing disposed outside the circuit board, the cable including a plurality of core wires and a shield layer disposed outside the core wires, the metal housing electrically connected with the shield layer. The circuit board has a lug disposed thereon, the lug including a grounding portion, the metal housing electrically connected with the grounding portion of the lug for grounding.

According to the present invention, the cable connector assembly connects the shield layer and metal housing by the circuit board, it can reduce the resistance of the power circuit, so that it can reduce the heat, and transmit a higher current.

DETAILED DESCRIPTION OF THE PREFERRED EMBODIMENT

Figure 1:
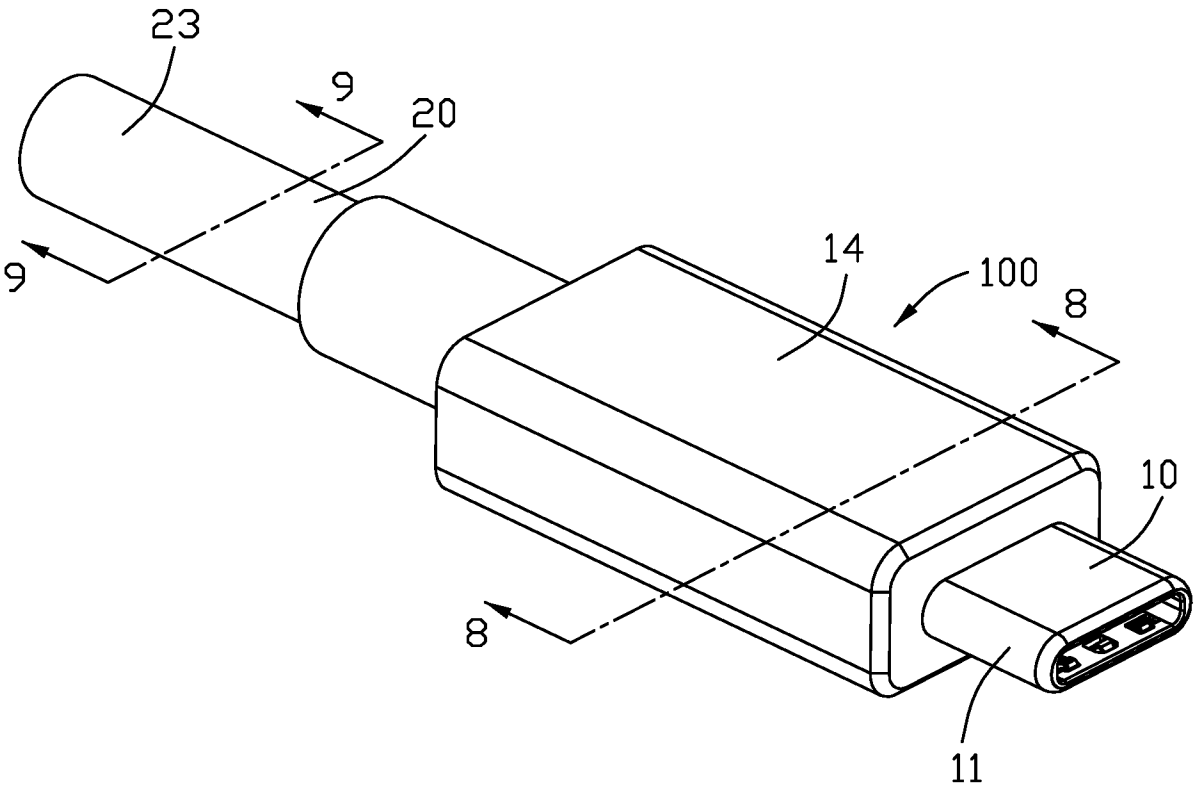
FIG. 1 is a perspective view of a cable connector assembly in accordance with present invention.
Figure 2:
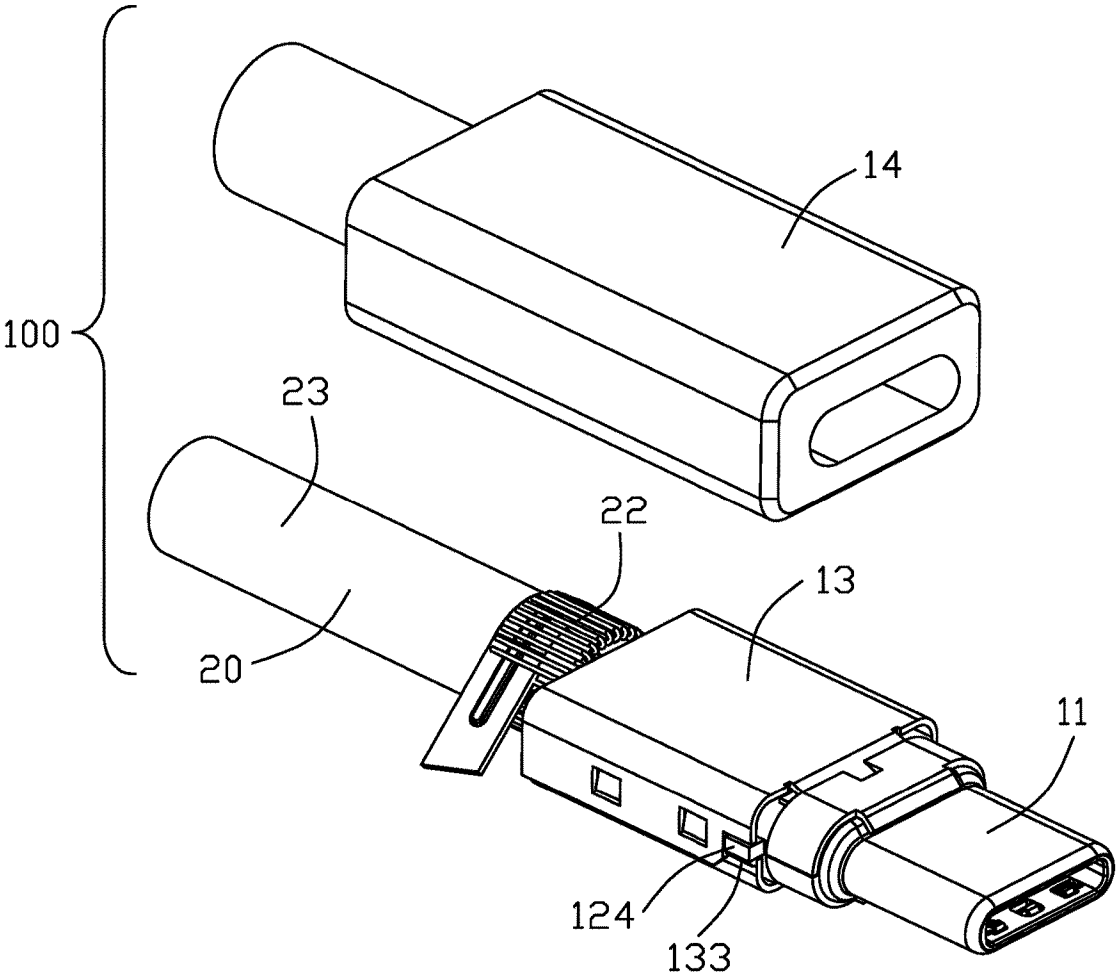
FIG. 2 is a partly exploded view of a first embodiment of the cable connector assembly as shown in FIG. 1.
Figure 3:
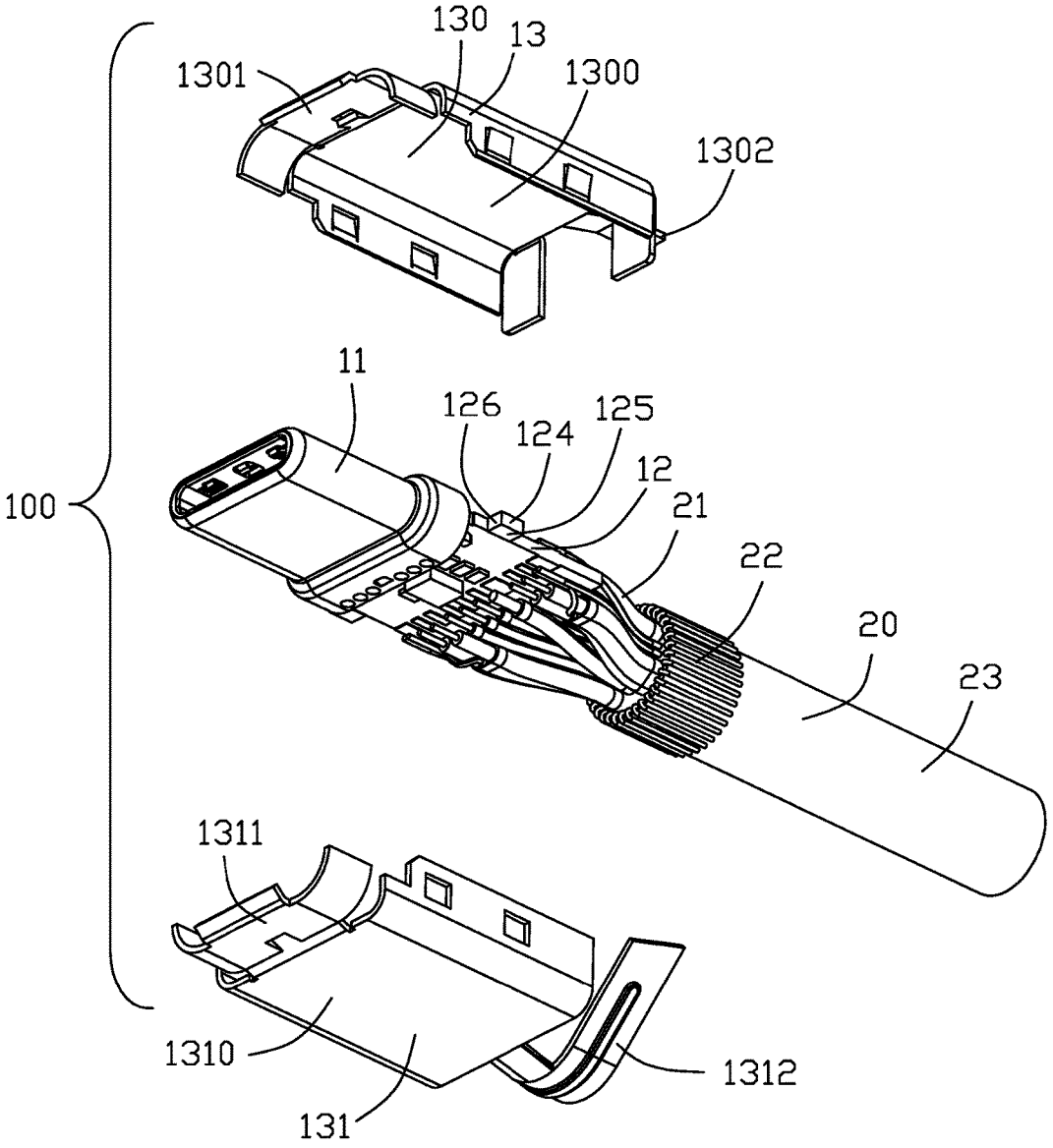
FIG. 3 is a further partly exploded view of the cable connector assembly as shown in FIG. 2.
Figure 4:
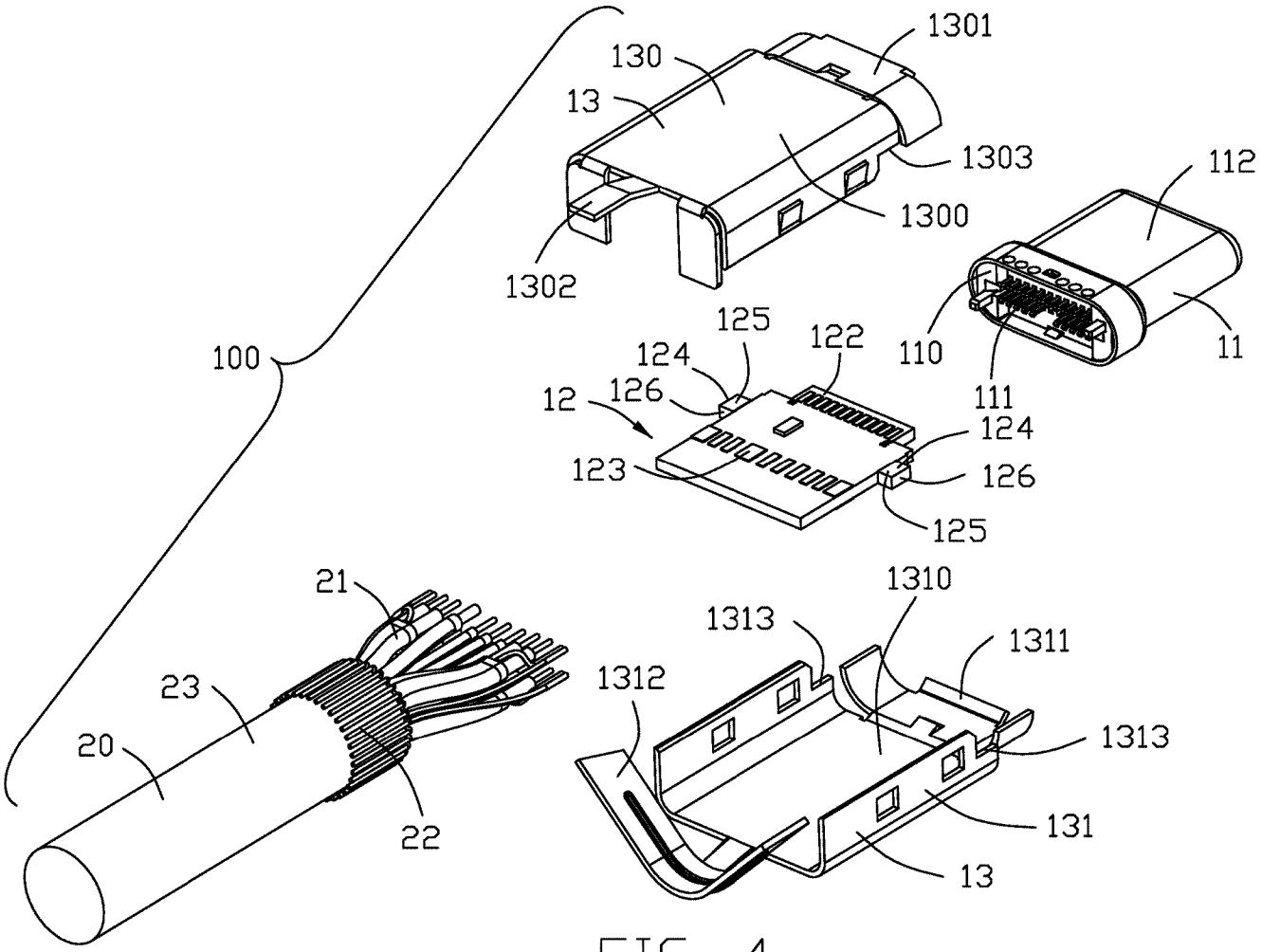
FIG. 4 is a further partly exploded view of the cable connector assembly as shown in FIG. 3.
Figure 5:
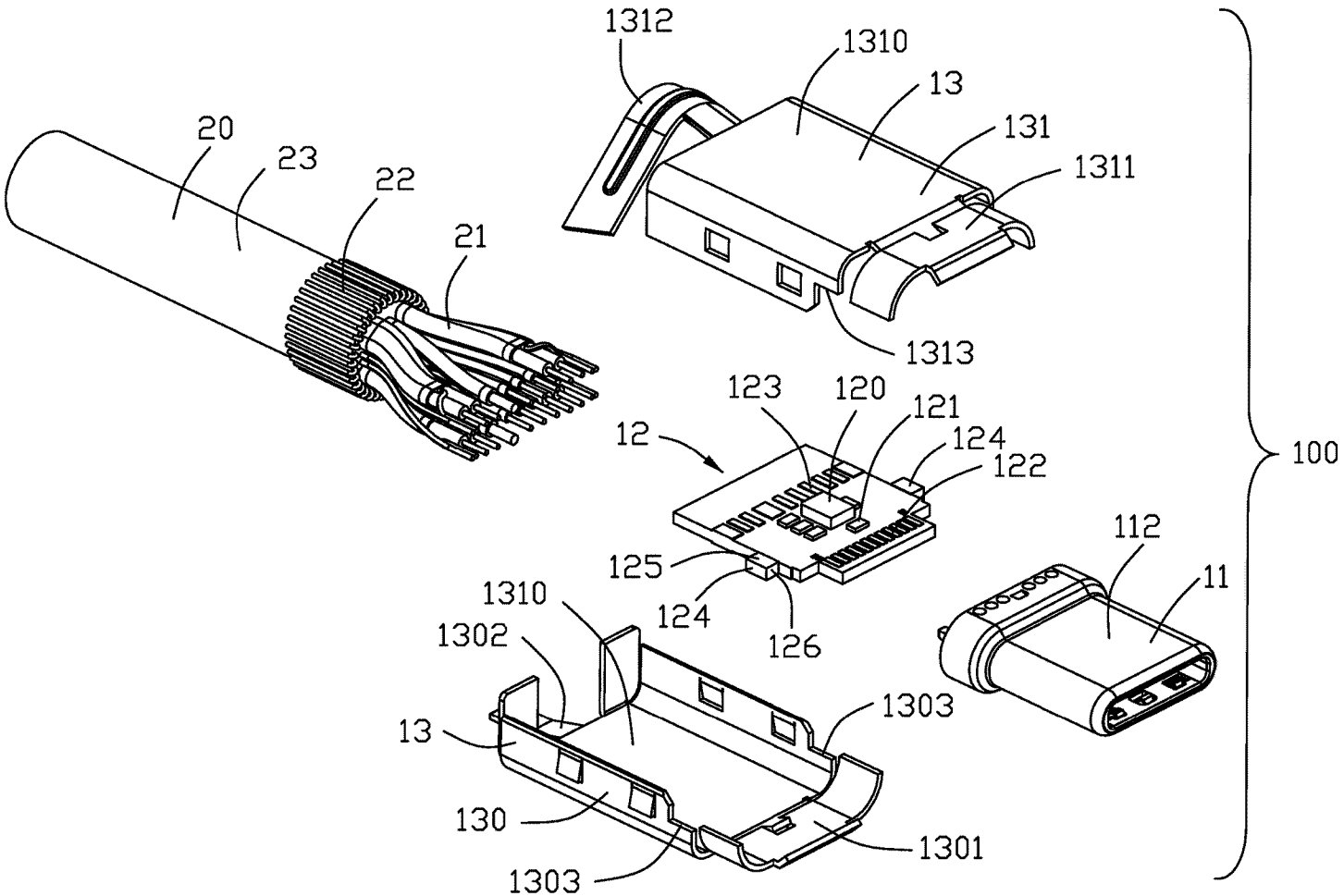
FIG. 5 is a further exploded view of the cable connector assembly as shown in FIG. 4, but from a different perspective.
Figure 6:
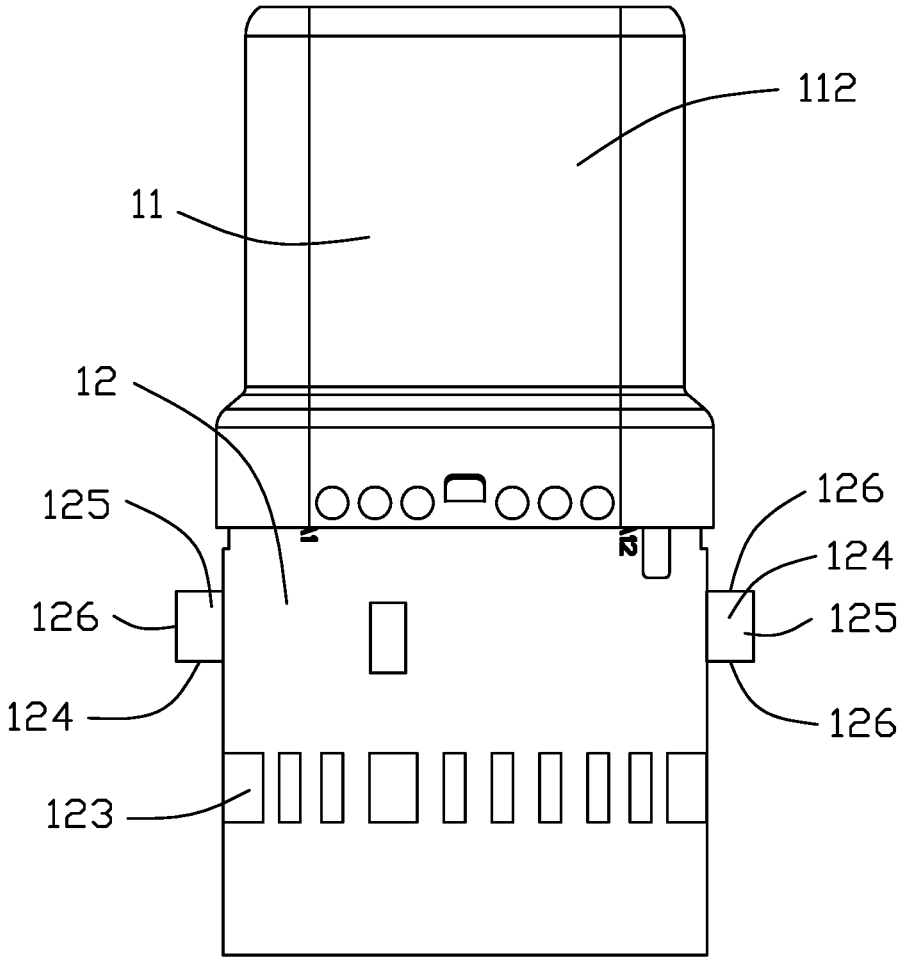
FIG. 6 is a top view of the mating plug and circuit board of the cable connector assembly as shown in FIG. 2.
Figure 7:
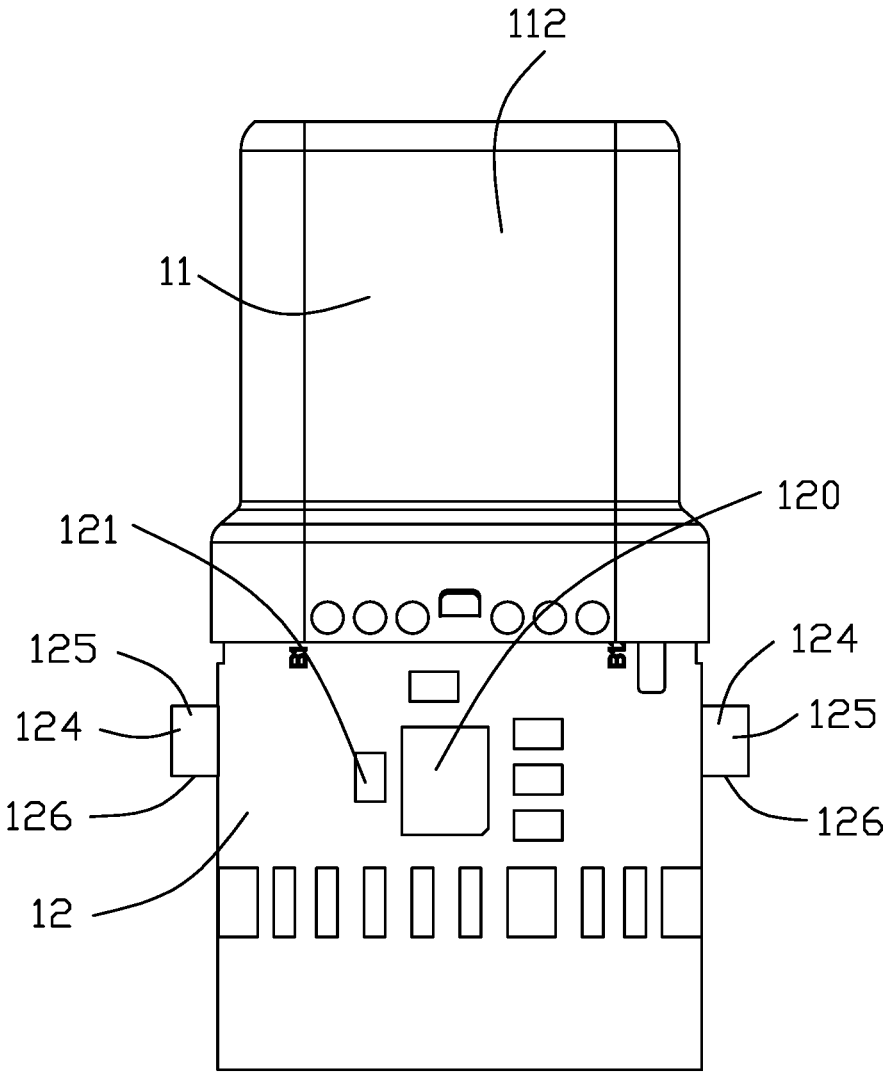
FIG. 7 is a bottom view of the mating plug and circuit board as shown in FIG. 6.
Figure 8:
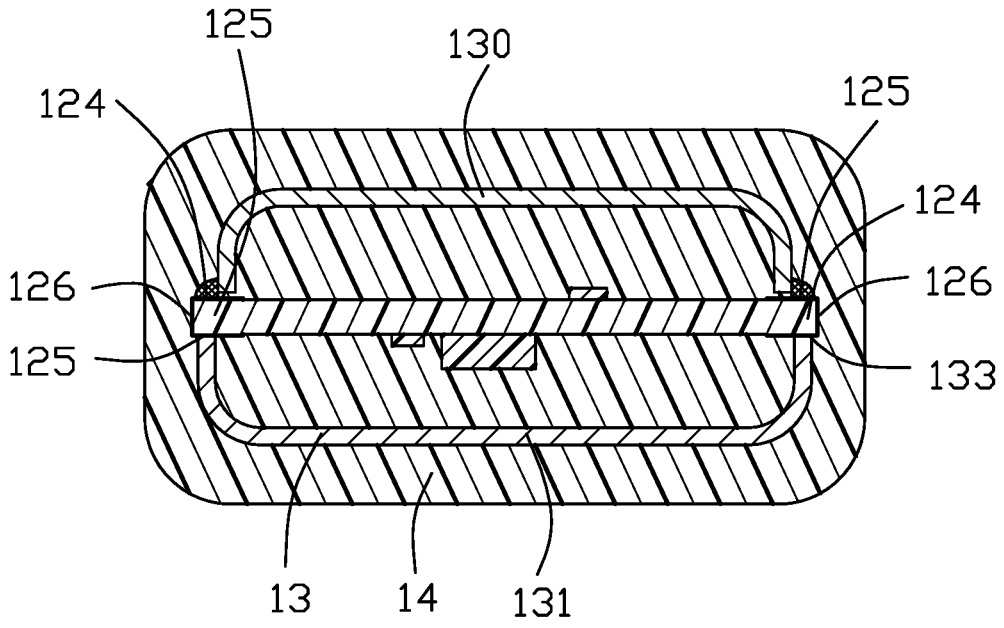
FIG. 8 is a cross-sectional view of the first embodiment follow the 8-8 direction as shown in FIG. 1.
Figure 9:
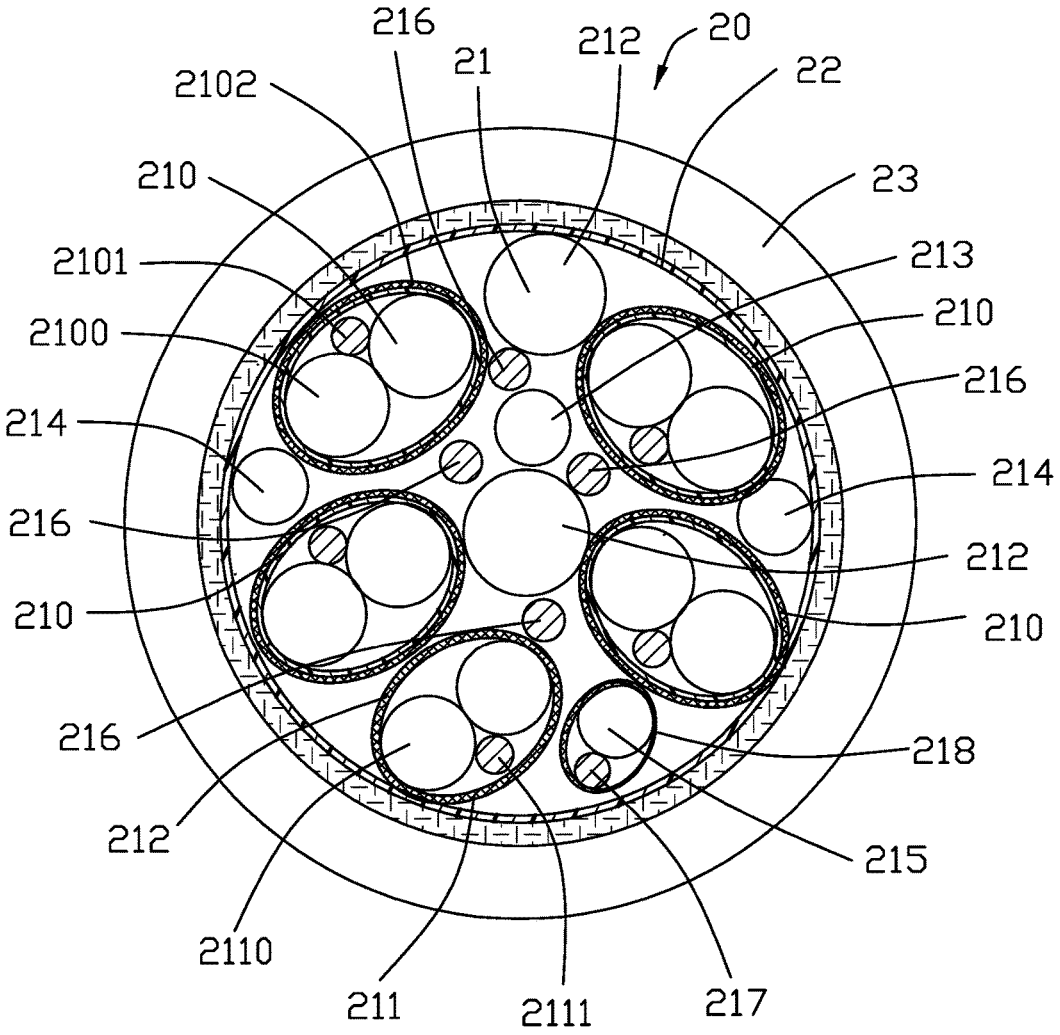
FIG. 9 is a cross-sectional view of the first embodiment follow the 9-9 direction as shown in FIG. 1.

Reference will now be made in detail to a first embodiment of the present invention. Referring to FIGS. 1 to 9, a cable connector assembly 100 includes a electrically connector 10 and a cable 20 connected with the electrically connector 10. The electrical connector 10 includes a mating plug 11 mated with a mating connector, a circuit board 12 connected with the mating plug 11 and the cable 20, a metal housing 13 disposed outside the circuit board 12, and a outer housing 14 disposed outside the metal housing 13. In this embodiment, the electrical connector 10 conforms to the USB C specification, and it can be mated with the mating connector in two opposite directions.

The mating plug 11 includes an insulative housing 110, a plurality of terminals received in the insulative housing 110 that are spaced in two rows in the up and down direction, and a metal housing 112 disposed outside the insulative housing 110. One end of each terminal 111 is received in the insulative housing 110 for being electrically and mechanically connected with the mating connector, and the other end of each terminal 111 extends beyond the insulative housing 110 and is electrically and mechanically connected with one end of the circuit board 12.

A chip 120 and other electrical elements 121 are mounted on the circuit board 12. The circuit board 12 includes a plurality of front spacers 122 disposed on the both sides of the front end of the circuit board, a plurality of rear spacers 123 disposed on the both sides of the rear end of the circuit board, and a tab/lug 124 disposed on the side edge of the circuit board 12 that extends outward. The number of the tab 124 is at least one, and in this embodiment, the number is two, and the tabs 124 are disposed on the two opposite sides of the circuit board 12. The tab 124 includes a grounding portion 125, and a metal layer 126 disposed on the side that perpendicular to the grounding portion 125.

The metal housing 13 includes an upper portion/shell 130 and a lower portion/shell 131 mated with the upper portion 130. The upper portion 130 includes a first body portion 1300, a first mating portion 1301 extending forward from the body portion 1300, and a connection portion 1302 extending rearward from the first body portion 1300. The lower portion 131 includes a second body portion 1310, a second mating portion 1311 extending forward from the second body portion 1310, and a second connection portion 1312 extending rearward from the second body portion 1310. The first mating portion 1301 and the second mating portion 1311 are mounted outside the rear end of the metal housing 112 of the mating plug 11, so that the metal housing 13 is electrically and mechanically connected with the metal housing 112 of the mating plug 11. The upper portion 130 snapped with the lower portion 131. The upper portion 130 has a lower gap 1303, and the lower portion 131 has an upper gap 1313, after the upper portion 130 being mated with the lower portion 131, the lower gap 1303 cooperating with the corresponding upper gap 1313 to form a receiving slot 133 receiving the corresponding tab 124, the metal housing 13 electrically connected with the grounding portion 125 of the tab 124 for grounding. The grounding portion 125 of the tab 124 is soldered to the metal housing 13 for electrical connection. After the tab 124 being soldered to the metal housing 13, a metal layer 126 and the solder in the soldering area enclose the gap between the tab 124 and the metal housing 13, to prevent electromagnetic interference from affecting the inner signal transmission of the cable connector assembly 100 through the gap. The ground connection between the metal housing 13 and the circuit board can also be achieved by elastic abutment, clamping, or the like.

The cable 20 includes a plurality of core wires, a shield layer 22 disposed outside the core wire 21, and an insulative layer 23 disposed outside the shield layer 22. The shield layer 22 is typically a metal woven material, or further a metal foil. The core wires 21 is soldered with a rear spacer 123 of the circuit board 12. The first connection portion 1302 is electrically connected with the shield layer 22, and the second connection 1312 is riveted on the shield layer 22 and is further riveted on the first connection portion 1302, so that the metal housing 13 is electrically connected with the shield layer 22. The core wires 21 include a plurality of pairs of differential signal core wire groups 210 transmitting a high speed differential signal, a low speed signal core wire group 211 transmitting a low speed differential signal, a pair of large power core wires 212 transmitting a high current, a small power core wire 213 transmitting a low current, a pair of spare core wires 214, and a control core wire 215 transmitting a control signal. The differential signal core wire group 210 includes a pair of coaxial wires 2100, a bare wire 2101 disposed outside the coaxial wires 2100, and a shield layer 2102 covering the bare wires 2101 and the coaxial wires 2100. The low speed signal core wire group 211 includes a pair of twisted wires 2110, a bare wire 2111 disposed outside the twisted wires 2110, and a shield layer 2112 covering the bare wire 2111 and the twisted wires 2110, so that it can reduce the external radiation and enhance its anti-interference ability. A pair of large power core wires 212 is connected with the circuit board 12, so that it can achieve the total 5 A current transmission, low power loss, low temperature rise, voltage drop of 500 mv, and the temperature rise will not beyond 25 degree during the using. The differential signal core wires 210 disposed on the outer layer, and each adjacent differential signal core wire group 210 includes at least the low speed signal core wire group 211, one of the large power core wires 212, a pair of spare core wires 214, and one of the control signal core wires 215. Specifically, in this embodiment, the number of the differential signal core wire groups 210 is four, and the number of the differential signal core wire groups 210 may be increased or decreased in according to the specific requirement, there are at least two of differential signal core wire groups 210 spaced between a pair of spare core wires 214. There is a control signal core wire 215 disposed between a pair of adjacent differential signal core wires 210 that has the low speed differential signal core wire group 211 disposed thereon, so that it can reduce the low frequency crosstalk of the low speed signal core wire group 211. With this arrangement, the distance between the pair of spare wires 214 and the control signal core wire 215 can be increased, to prevent mutual coupling and crosstalk to the low speed signal core group 211. The other large power core wire 212 is disposed in the inner layer of the cable 20, and the small power core wire 213 is disposed between the pair of large power core wires 212. The cable 20 further includes a plurality of bare wires 216 disposed in the inner layer for grounding. The cable 20 further includes a bare wire 217 disposed beside the control signal core wire 215 and a shield layer 128 covering the bare wire 217 and the control signal core wire 215. The bare wire 217 is used as grounding, to prevent from the noise crosstalk. The small power core wire 213 is used to supply the power for the chip 120 on the circuit board 12.

All of the bare wires 2101, 2111, 216, 217 are electrically connected with the grounding layer on the circuit board 12, and further in series with the shield layer 22 of the cable 20 and the metal housing 13 as the power return of the high current, so that it can reduce the resistance of the power circuit of the high current, and the voltage is lowered by 500 mV.

Figure 10:
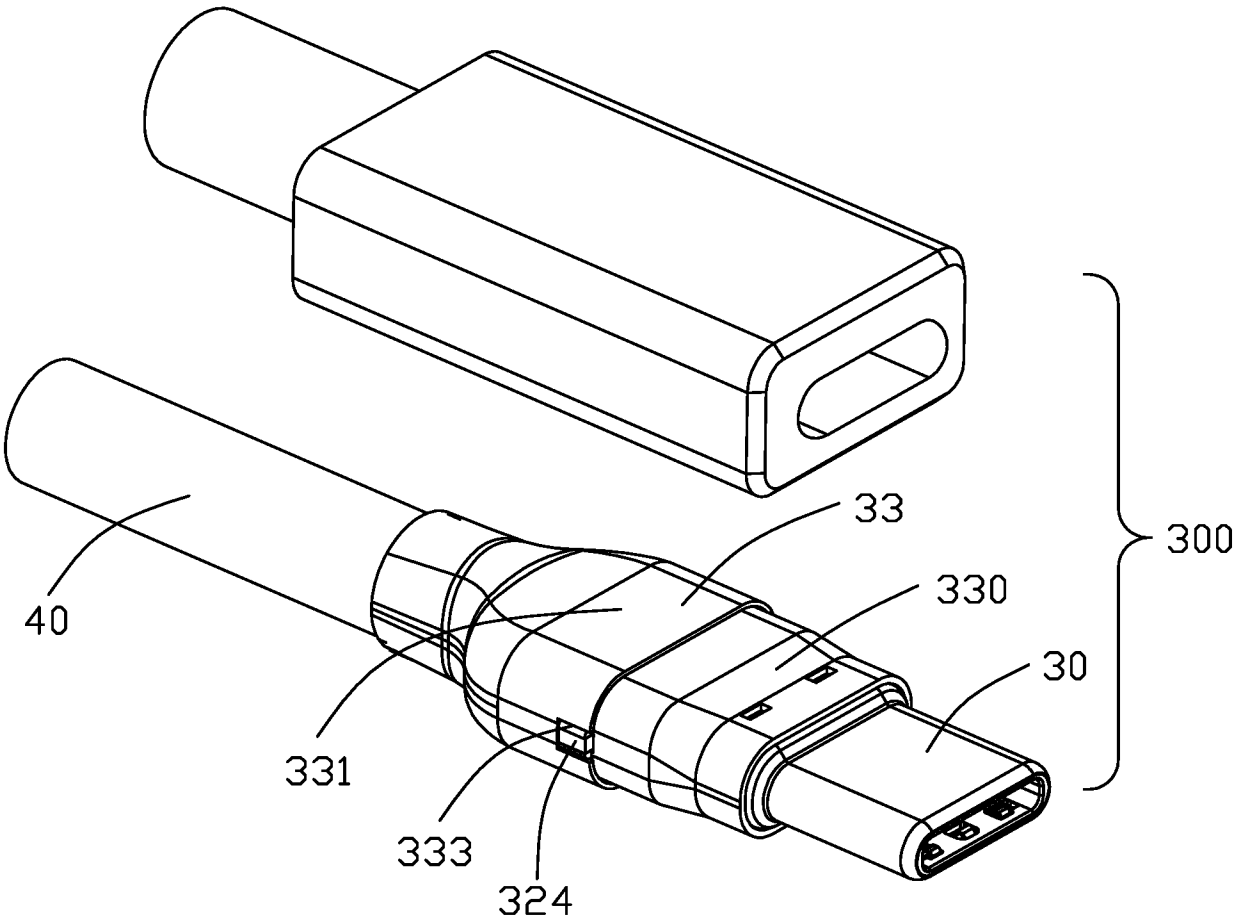
FIG. 10 is a partly exploded view of a second embodiment of the cable connector assembly as shown in FIG. 1.
Figure 11:
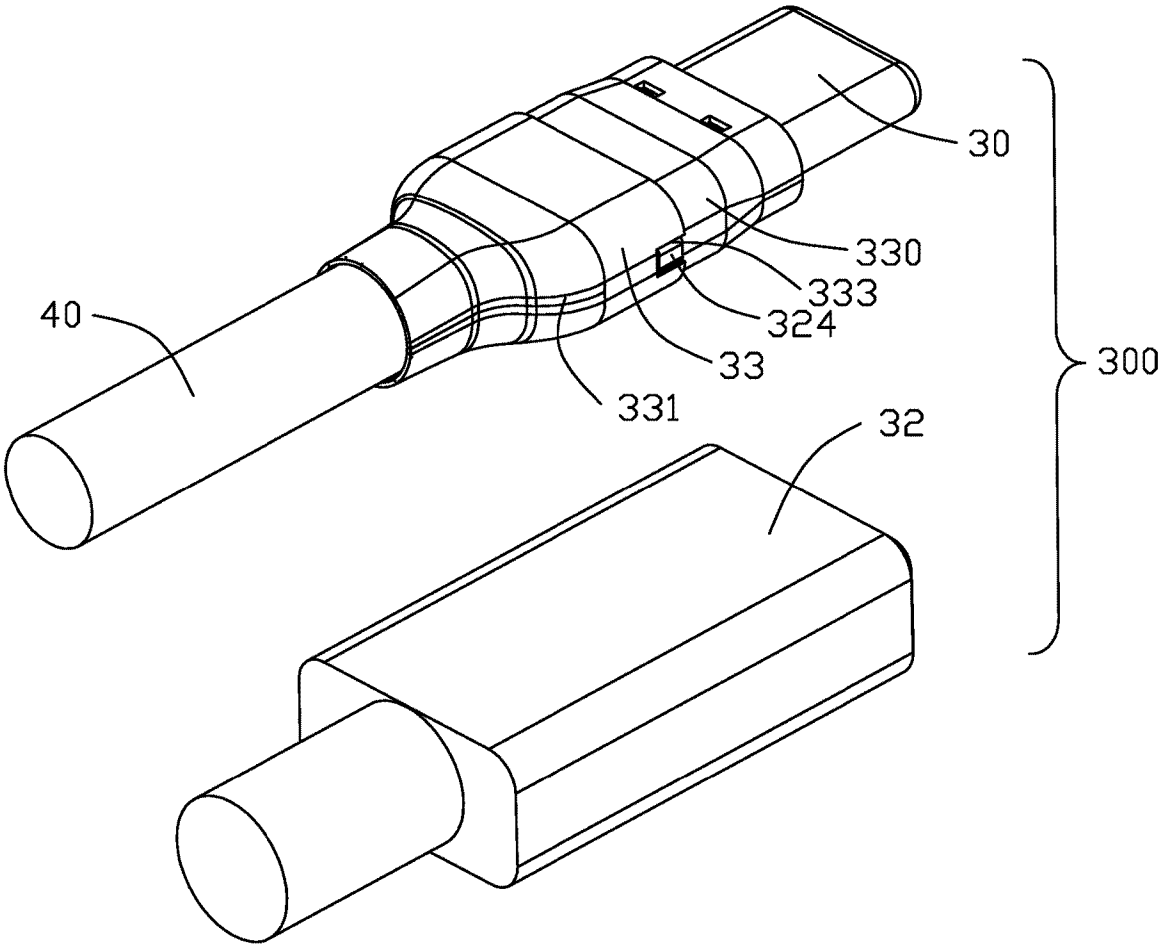
FIG. 11 is a further partly exploded view of the cable connector assembly as shown in FIG. 10, but from a different perspective.
Figure 12:
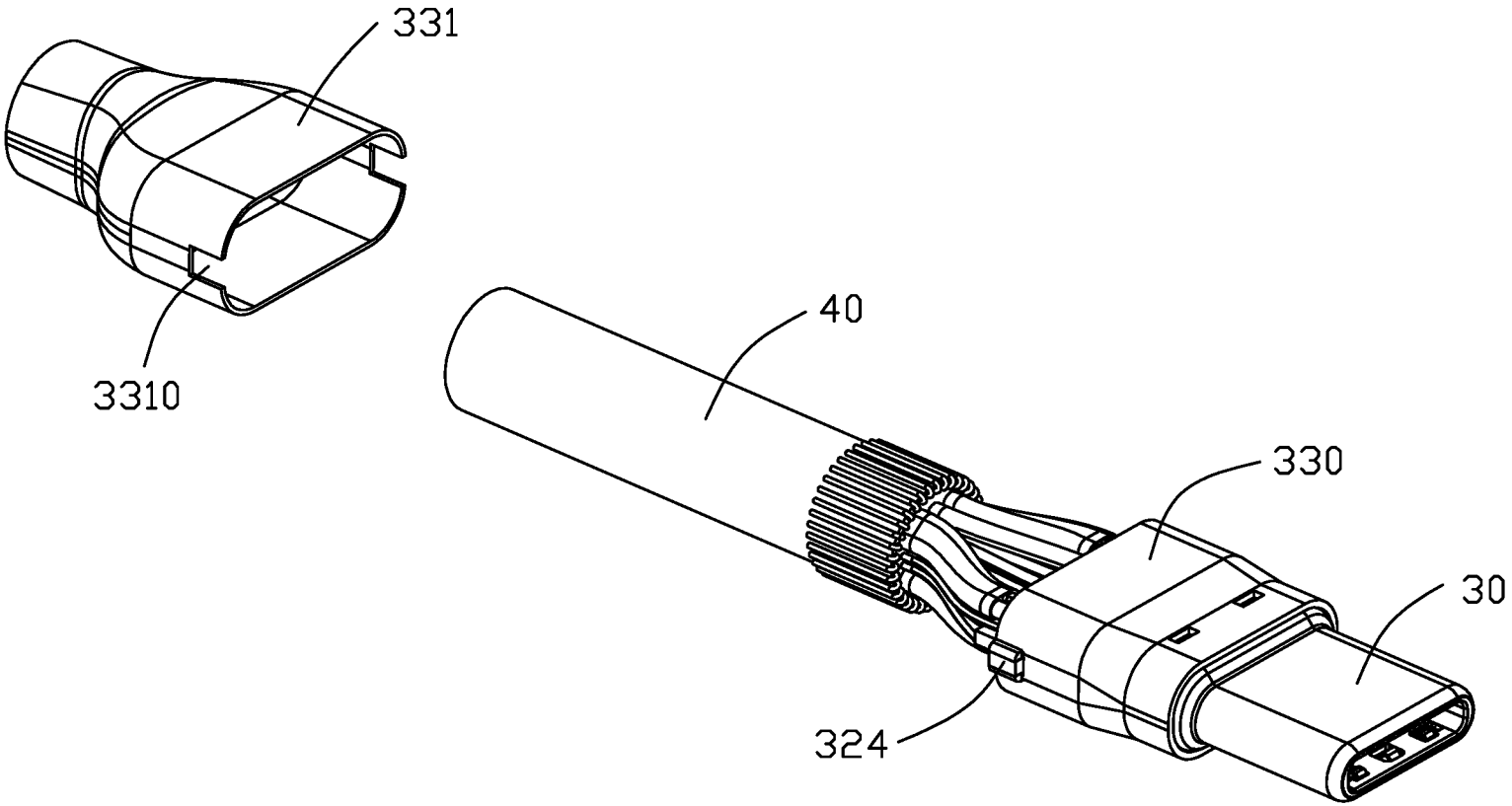
FIG. 12 is a further exploded view of the cable connector assembly after being removed an outer housing as shown in FIG. 10.
Figure 13:
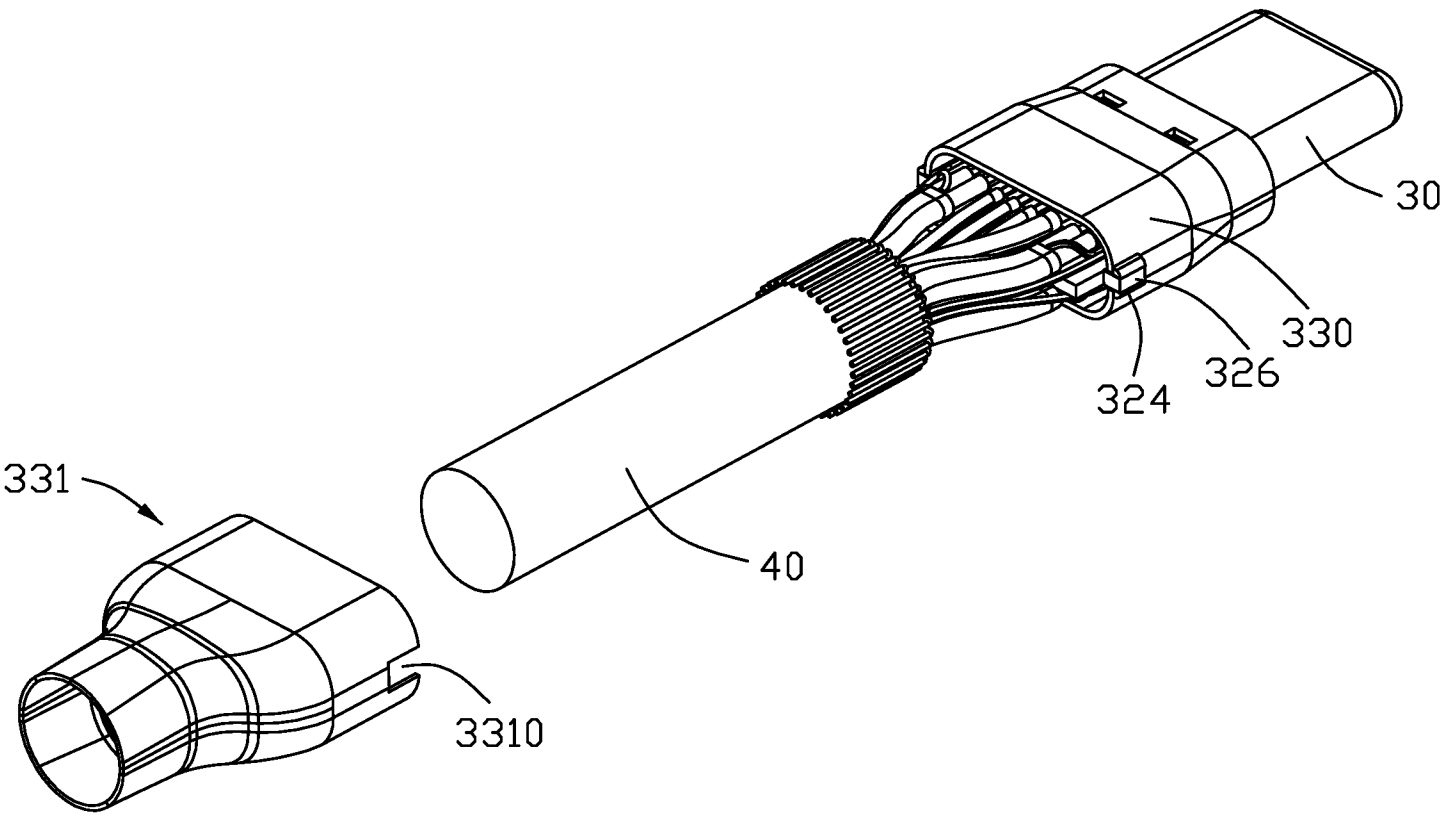
FIG. 13 is a further exploded view of the cable connector assembly after being removed the outer housing as shown in FIG. 12, but from a different perspective.
Figure 14:
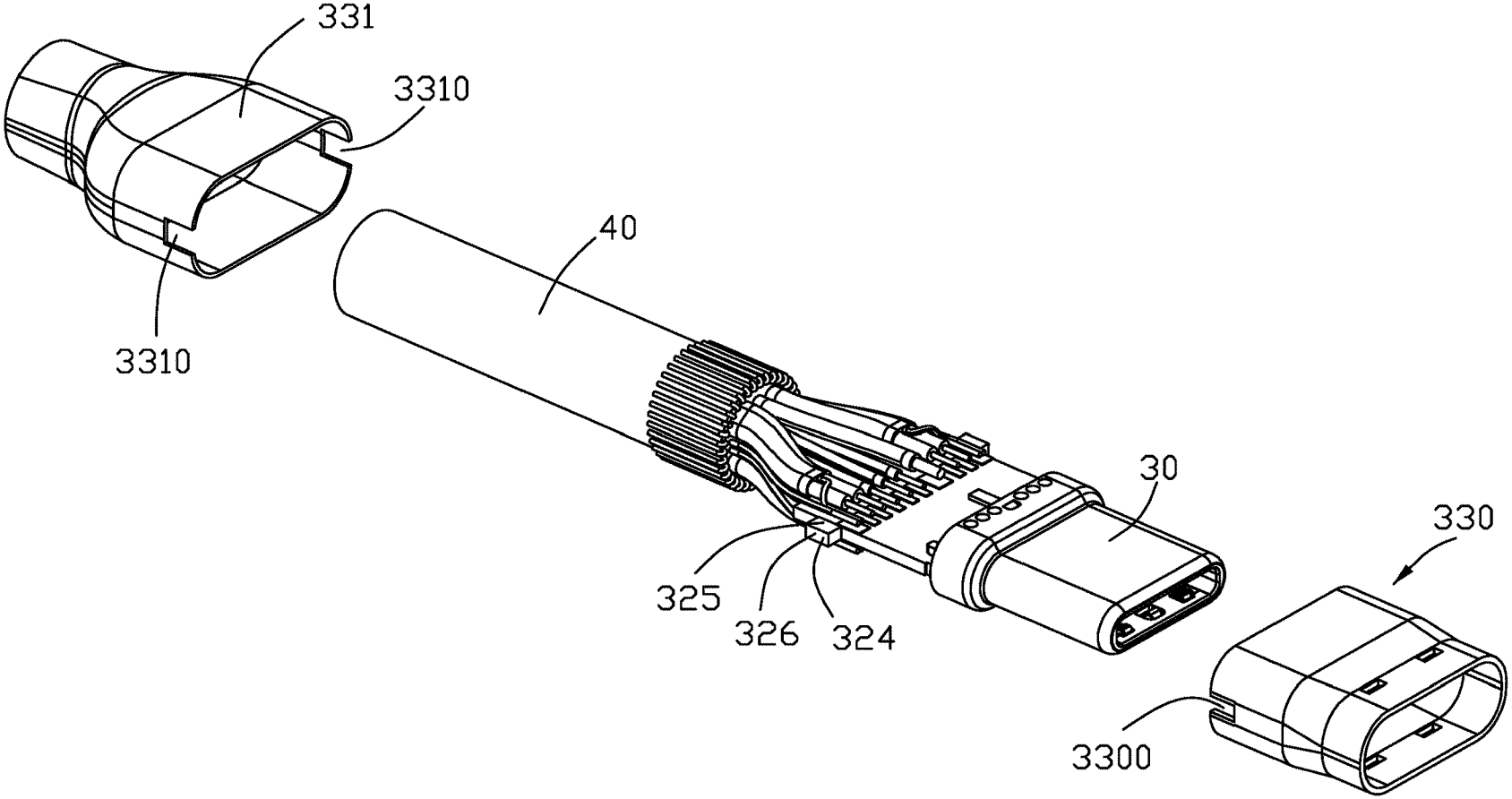
FIG. 14 is a further exploded view of the cable connector assembly as shown in FIG. 12.
Figure 15:
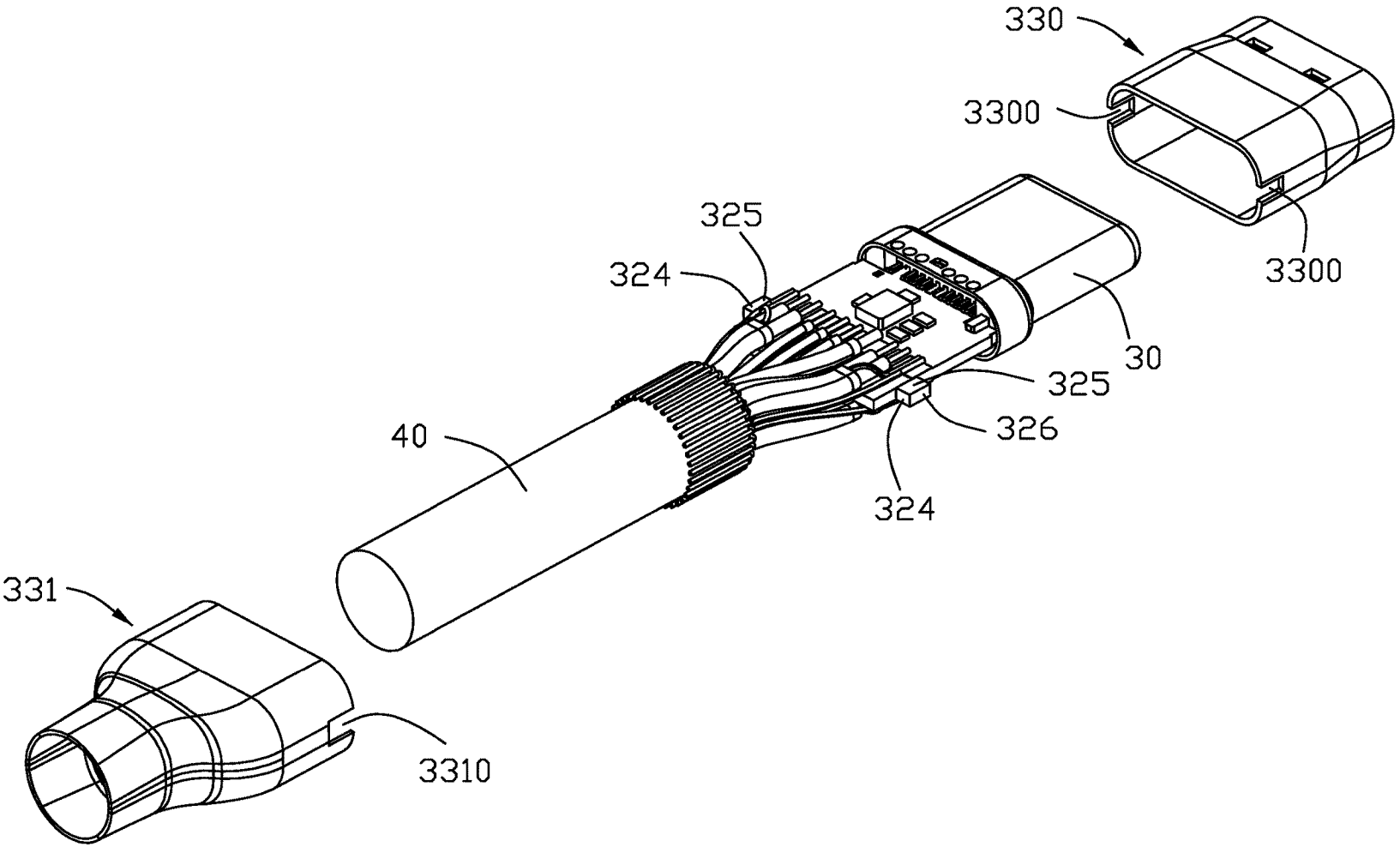
FIG. 15 is a further exploded view of the cable connector assembly as shown in FIG. 14, but from a different perspective.
Figure 16:
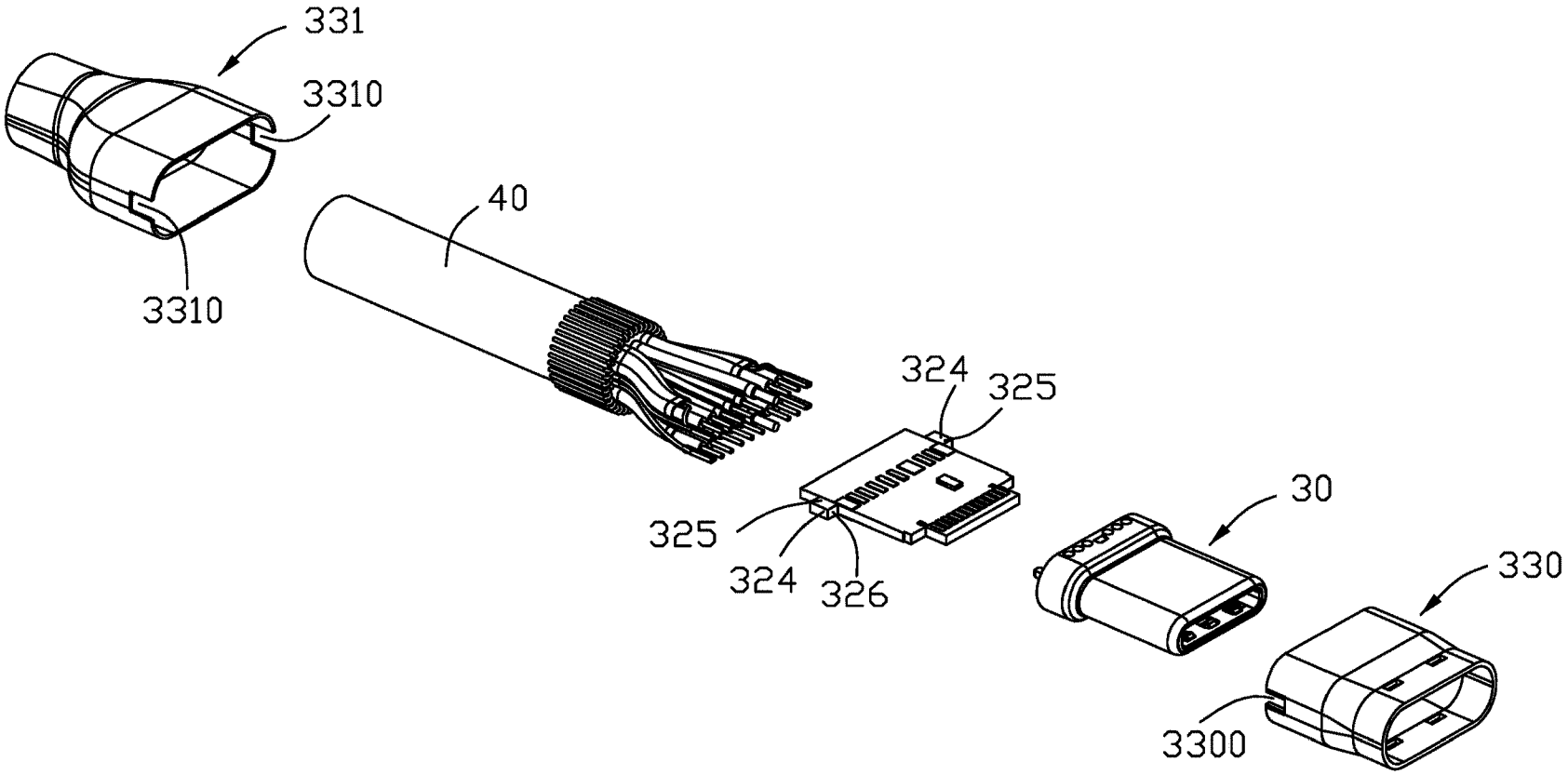
FIG. 16 is a further exploded view of the cable connector assembly as shown in FIG. 14.
Figure 17:
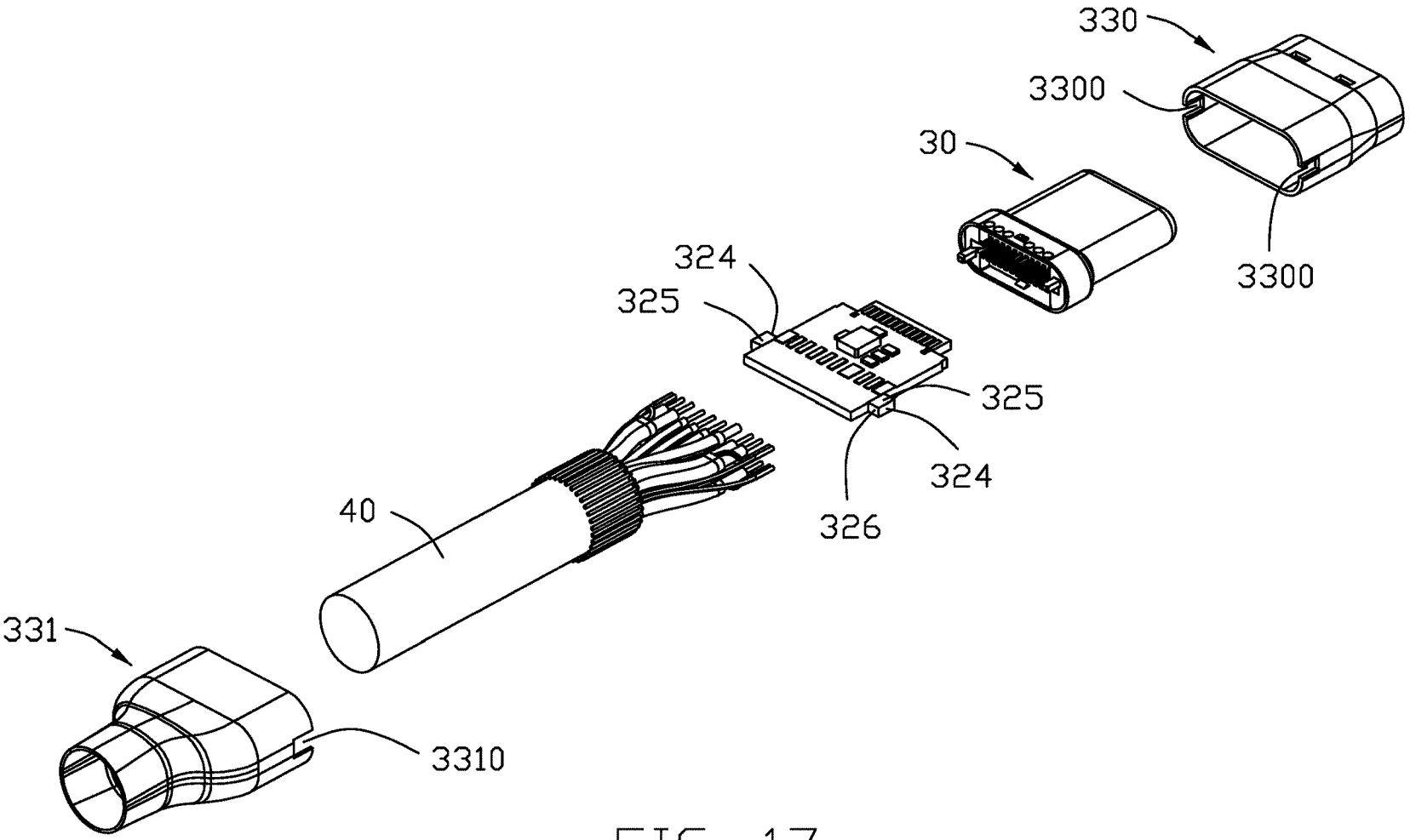
FIG. 17 is a further exploded view of the cable connector assembly as shown in FIG. 16, but from a different perspective.
Figure 18:
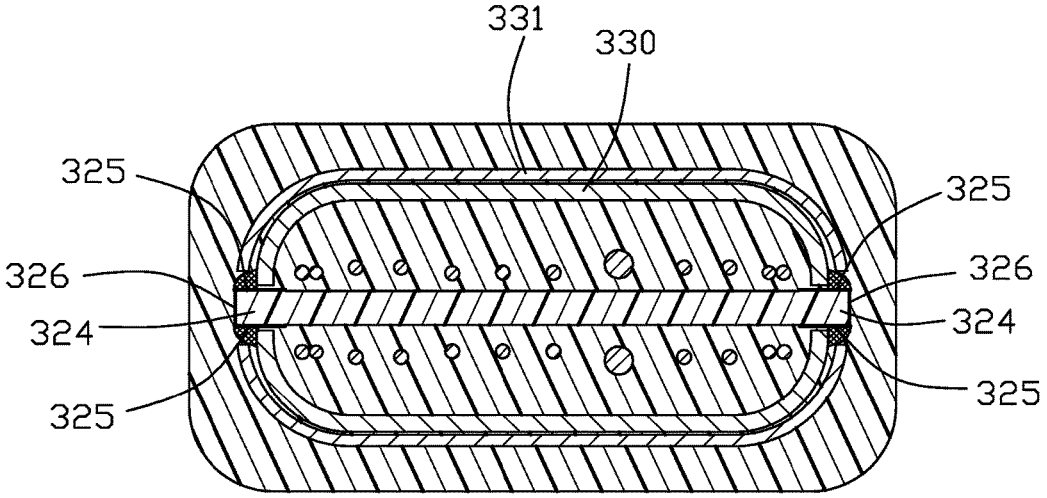
FIG. 18 is a cross-sectional view of the second embodiment follow the 8-8 direction as shown in FIG. 1.

Referring to the FIG. 1, 10-18, a cable connector assembly 300 in according to the second embodiment of the prevent invention includes an electrical connector 30 and a cable 40 connected with the electrical connector 30. The difference between the structures of the second embodiment cable connector assembly 300 and the first embodiment cable connector assembly 100 is only in the metal housing 33, the other structures are the same and will not be described herein. Of course, the same part of the cable connector assemblies can be disposed in other ways due to the specific requirements.

The metal housing 33 includes a front portion 330 and a rear portion 331 mated with the front portion 330. The front portion 330 and the rear portion 331 are all circumferentially closed, so that the front portion 330 and the rear portion 331 can be sleeved and mounted with each other. The front portion 330 includes a pair of rear gaps 3300 that opens rearward, and the rear portion 331 includes a pair of front gaps 3310 that opens forward. Each rear gap 3300 cooperate with the front gap 3310 to form a receiving slot 333 receiving a corresponding tab 324. The grounding portion 325 of the tab 324 is soldered with the metal housing 33 for electrical connection. After the tab 324 being soldered with the metal housing 33, the metal layer 326 and the solder in the soldering area enclose the gap between the tab 34 and the metal housing 33, to prevent electromagnetic interference from affecting the inner signal transmission of the cable connector assembly 300 through the gap.

The cable connector assembly 100, 300 of the present invention connects the shield layer 22 of the cable 20 and the metal housing 13, 33 through the circuit board 12, and it can reduce the resistance of the power return, so that it can reduce heat generation and transmit a higher current.

What is claimed is:

1. A cable connector assembly comprising:

an electrical connector including a mating plug for mating with a mating connector, a circuit board connected with the mating plug, and a metal housing disposed outside the circuit board; and a cable connected with the electrical connector, the cable including a plurality of core wires and a shield layer disposed outside the core wires, the shield layer electrically connected with the metal housing; wherein the circuit board comprises a lug, the lug having a grounding portion electrically connected with the metal housing;

the metal housing comprises a receiving slot receiving the lug, the grounding portion of the lug electrically connected with the metal housing in the receiving slot; wherein the grounding portion of the lug is soldered to the metal housing; wherein the lug comprises a metal layer disposed on a side of the lug that is perpendicular to the grounding portion, after the lug being soldered to the metal housing, the metal layer and the solder in the soldering area seal a gap between the lug and the metal housing.

2. The cable connector assembly of claim 1, wherein there are two lugs disposed on two opposite sides of the circuit board.

3. The cable connector assembly of claim 1, wherein the metal housing comprises an upper portion and a lower portion mated with the upper portion, the upper portion cooperating with the lower portion to form the receiving slot.

4. The cable connector assembly of claim 3, wherein the upper portion comprises a lower gap and the lower portion comprises an upper gap, the lower gap cooperating with the upper gap to form the receiving slot.

5. The cable connector assembly of claim 1, wherein the metal housing comprises a front portion and a rear portion mated with the front portion, the front portion cooperating with the rear portion to form the receiving slot.

6. The cable connector assembly of claim 5, wherein the front portion comprises a rear gap that opens rearward, and the rear portion comprising a front gap that opens forward, the rear gap cooperating with the front gap to form the receiving slot.

7. The cable connector assembly of claim 5, wherein the front portion and the rear portion are both circumferentially closed.

8. A cable connector assembly comprising:

an electrical connector including a mating plug for mating with a complementary connector, a printed circuit board located behind the mating plug in a front-to-back direction, and mechanically and electrically connected to the mating plug, a pair of tabs formed on the printed circuit board with corresponding grounding portions thereon;

a cable located behind the printed circuit board in the front-to-back direction and including a plurality of wires respectively electrically and mechanically connected to the printed circuit board; wherein the connector further includes a metallic housing enclosing at least a rear portion of the plug connector, the printed circuit board and front portions of the wires; wherein the metallic housing defines structures not only mechanically interengaged with the pair of tabs for securement consideration, but also electrically connected therewith for grounding; wherein said pair of tabs are formed on two opposite lateral sides of the printed circuit board in a transverse direction perpendicular to the front-to-back direction; wherein the metallic housing includes an upper shell and a lower shell commonly forming a pair of notches to receive the pair of tabs therein, respectively; wherein the metallic housing includes a front shell and a rear shell surrounding the front shell around a joined region between the front shell and the rear shell; wherein the upper shell and the lower shell are formed by the rear shell.

9. The cable connector assembly as claimed in claim 8, wherein the grounding portion of each of the tabs is soldered to the metallic housing.

10. The cable connector assembly as claimed in claim 8, wherein the front shell forms a pair of notches in a rear edge region to respectively receive the pair of tabs therein, and the rear shell forms a pair of notches in a front edge region to respectively receive the pair of tabs therein.

11. The cable connector assembly as claimed in claim 8, wherein the metallic housing further mechanically and electrically connects to a conductive shielding lay of the cable which surrounds the wires.

12. A cable connector assembly comprising:

an electrical connector including a mating plug for mating with a complementary connector, a printed circuit board located behind the mating plug in a front-to-back direction, and mechanically and electrically connected to the mating plug, a grounding portion formed on the printed circuit board;

a cable located behind the printed circuit board in the front-to-back direction and including a plurality of wires surrounded by a conductive shielding layer and respectively electrically and mechanically connected to the printed circuit board, said wires including drain wires soldered upon grounding pads on the printed circuit board for grounding; wherein the connector further includes a metallic housing enclosing a rear portion of the plug connector, the printed circuit board and front portions of the wires; wherein the metallic housing is soldered upon the grounding portion in a front area and grasping the shielding layer in a rear area to establish a grounding loop among the metallic housing, the printed circuit board and the cable; wherein the grounding portion is located on a tab protruding on a lateral edge of the printed circuit board; wherein the metallic housing forms a notch to compliantly receive the tab therein.

* * * * *